US007805873B2

(12) United States Patent
Bentley

(10) Patent No.: US 7,805,873 B2
(45) Date of Patent: Oct. 5, 2010

(54) MODULAR CHEEK REST AND STORAGE ASSEMBLY

(75) Inventor: James K. Bentley, Paso Robles, CA (US)

(73) Assignee: Blackhawk Industries Product Group Unlimited LLC, Norfolk, VA (US)

( * ) Notice: Subject to any disclaimer, the term of this patent is extended or adjusted under 35 U.S.C. 154(b) by 292 days.

(21) Appl. No.: 11/594,578

(22) Filed: Nov. 8, 2006

(65) Prior Publication Data

US 2007/0101631 A1 May 10, 2007

Related U.S. Application Data

(60) Provisional application No. 60/734,695, filed on Nov. 8, 2005.

(51) Int. Cl.
*F41C 23/00* (2006.01)

(52) U.S. Cl. ..... 42/74; 42/71.01; 42/72

(58) Field of Classification Search ..... 42/70.11, 42/71.01–74, 90
See application file for complete search history.

(56) References Cited

U.S. PATENT DOCUMENTS 1,693,289 A * 11/1928 Warren ..... 42/71.01
2,100,514 A * 11/1937 Miller et al. ..... 42/71.01
2,509,553 A * 5/1950 Wylie ..... 42/71.02
4,120,108 A * 10/1978 Vickers et al. ..... 42/74
4,628,627 A * 12/1986 Johnson ..... 42/90
4,850,127 A * 7/1989 Davis et al. ..... 42/71.01
4,944,109 A * 7/1990 Zedrosser ..... 42/71.01
5,121,564 A * 6/1992 Story ..... 42/90
5,159,136 A * 10/1992 Marsh ..... 42/71.01
5,225,613 A * 7/1993 Claridge ..... 42/74
5,265,365 A * 11/1993 Finn ..... 42/74
5,636,465 A * 6/1997 Johnson ..... 42/90
D382,037 S * 8/1997 Scott et al. ..... D22/108
5,711,102 A * 1/1998 Plaster et al. ..... 42/71.01
5,813,157 A * 9/1998 Scott et al. ..... 42/71.01
5,970,642 A * 10/1999 Martin ..... 42/73
6,250,194 B1 * 6/2001 Brandl et al. ..... 89/1.41
6,457,273 B2 * 10/2002 Gussalli Beretta ..... 42/73
6,698,129 B1 * 3/2004 Hanks ..... 42/90
6,829,855 B2 * 12/2004 Seifert ..... 42/90
6,925,744 B2 * 8/2005 Kincel ..... 42/71.01
7,162,822 B1 * 1/2007 Heayn et al. ..... 42/73
2004/0016167 A1 * 1/2004 Fitzpatrick et al. ..... 42/71.01
2004/0060220 A1 * 4/2004 Peddie ..... 42/71.01
2004/0226211 A1 * 11/2004 Keeney et al. ..... 42/71.01

(Continued)

*Primary Examiner*—Stephen M Johnson
*Assistant Examiner*—Daniel J Troy
(74) *Attorney, Agent, or Firm*—Bowman Green Hampton & Kelly, PLLC

(57) ABSTRACT

A modular cheek rest assembly for a gunstock. The major members of the assembly are a low level cheek rest, a high level cheek rest, a storage container, a shotgun shell holder and a magazine holder. The low level cheek rest is the principal member that has engagement structure adjacent the bottom ends of its side walls for detachably securing the low level cheek rest to the butt stock of a firearm. There are attachment structure on the outer surface of the side walls of the low level cheek rest for disengageably attaching the other members. There is the ability to attach these members on either the right or left side depending on the preference of the user. If the high level cheek rest is needed, it nests over the top of the low level cheek rest.

16 Claims, 6 Drawing Sheets

U.S. PATENT DOCUMENTS

2005/0039368 A1* 2/2005 Crawford ..... 42/72
2006/0010749 A1* 1/2006 Kincel ..... 42/71.01
2006/0037227 A1* 2/2006 Bredeson ..... 42/90
2006/0096146 A1* 5/2006 Fitzpatrick et al. ..... 42/71.01
2006/0288626 A1* 12/2006 Kim ..... 42/73
2007/0101631 A1* 5/2007 Bentley ..... 42/74
2007/0261284 A1* 11/2007 Keng ..... 42/73
2007/0289190 A1* 12/2007 Oz ..... 42/73
2008/0005951 A1* 1/2008 Gorzen ..... 42/14

* cited by examiner

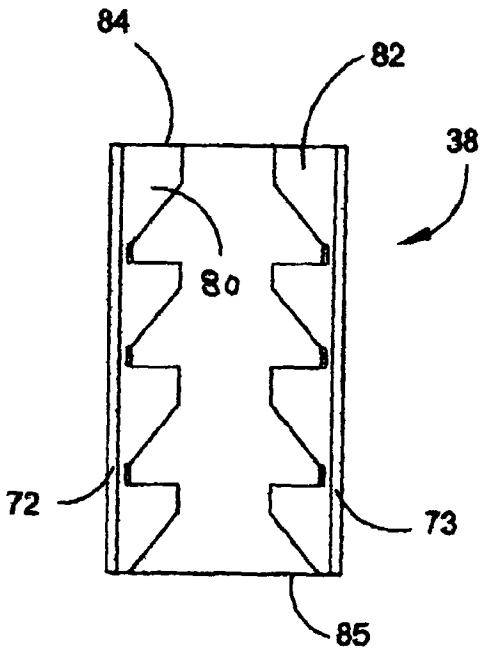
FIG. 15
FIG. 14
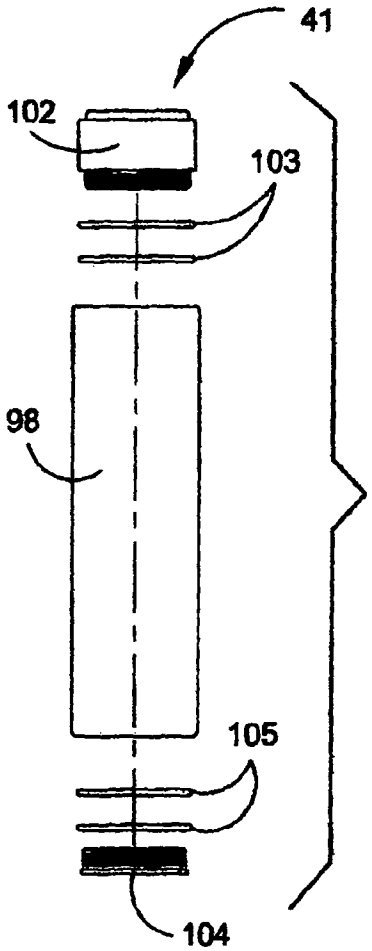
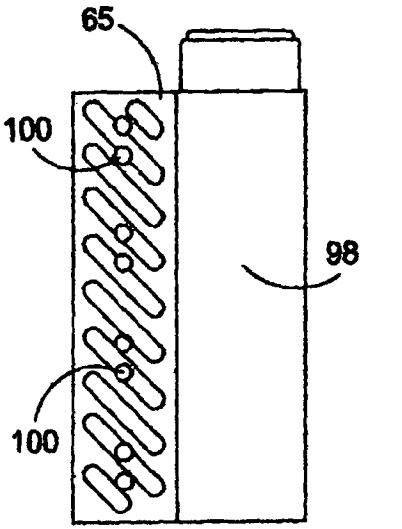
FIG. 12
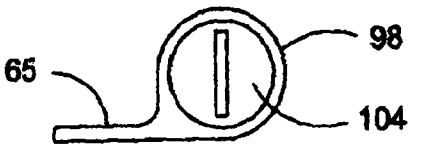
FIG. 13

MODULAR CHEEK REST AND STORAGE ASSEMBLY

This application claims the priority of U.S. Provisional Patent Application 60/734,695 filed on Nov. 8, 2005.

BACKGROUND OF THE INVENTION

The invention relates to firearms such as shotguns and rifles. More specifically the invention relates to a modular cheek rest assembly that is detachably secured to the butt stock of a firearm.

If the firearm has a low level sight, a low level cheek rest is needed. If an elevated sight is used on the firearm, then a high level cheek rest is needed.

Sometimes the firearm user needs quick access to shells for use with the firearm. The firearm user may put the shells in a pocket and often this takes a longer to get them out to use than the user would like. At such times as this, it would be advantageous to have some type of shotgun shell holder or magazine holder detachably mounted on the butt stock. There are times when it would be advantageous to have a storage tube detachably secured to the butt stock.

It is an object of the invention to provide a novel modular cheek rest assembly that includes a low level cheek rest, a high level cheek rest, a storage tube and a shotgun shell holder.

It's another object of the invention that is easily installed and removed from a gun stock.

It's also an object of the invention to provide a novel modular cheek rest assembly that is economical to manufacture and market.

SUMMARY OF THE INVENTION

The principal components of the invention are a low level cheek rest, a high level cheek rest, a shotgun shell holder, a magazine holder and a storage tube. If the firearm has a low level sight, the low level cheek rest would be used. Different options then exist. A shotgun shell holder could be removably attached to either one or both sides of the low level cheek rest. Alternatively, a storage tube could be attached to either side of the low level cheek rest and a shotgun shell holder could be attached to the other side. If an elevated sight is used on the firearm, then the high level cheek rest could be matingly nested over the low level cheek rest. The low level cheek rest allows the person shooting the firearm to hold their cheek at the proper height to see the low level gun sight. The high level cheek rest allows the person shooting the firearm to hold their face at the proper height to see an elevated gun sight.

If the high level cheek rest is used, the previous options available for the low level cheek rest would also be available for the high level cheek rest. A shotgun shell holder could be removably attached to either one or both sides of the high level cheek rest. Alternatively, a storage tube could be attached to either side of the high level cheek rest and a shotgun shell holder or a magazine holder could be attached to the other side.

The low level cheek rest has a top wall portion connected at its opposite ends by a left side wall and a right side wall. Adjacent the bottom end of the side walls are a plurality of longitudinally spaced teeth. These teeth would be detachably engageable with aligned recesses in the respective right and left recesses in the outer surface of a butt stock. The low level cheek rest is made of a semi-rigid material, such as some form of plastic, that allows the side walls to be stretched outwardly in order to mount the low level cheek rest on the butt stock.

DESCRIPTION OF THE DRAWINGS

FIG. 12 is a side elevation view of the storage tube;

FIG. 13 is a rear elevation view of the storage tube;

FIG. 14 is an exploded top plan view of the storage tube;

FIG. 15 is a bottom view of the low level cheek rest; and

DESCRIPTION OF THE PREFERRED EMBODIMENT

Figure 1:
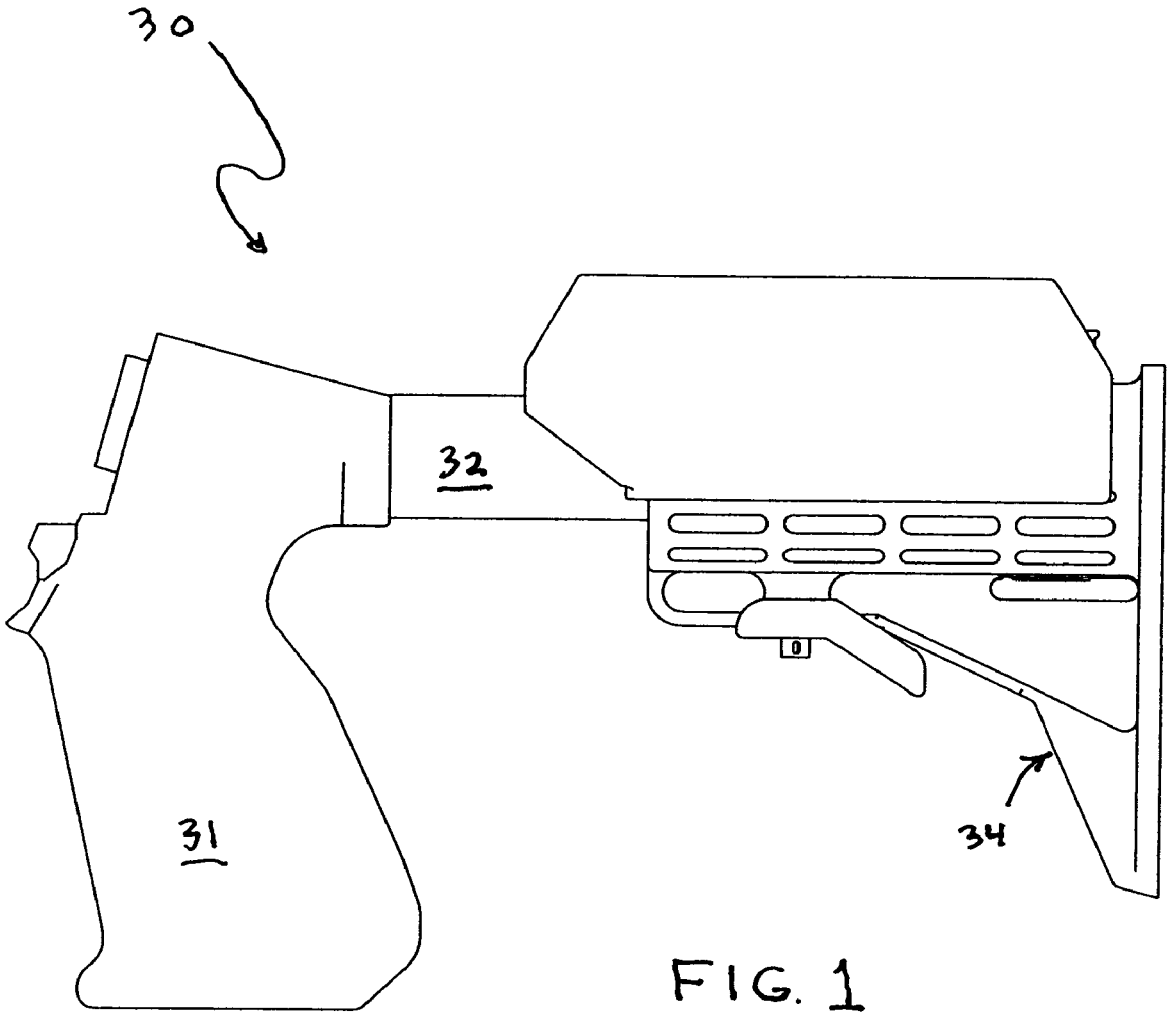
FIG. 1 is a side elevation view of the adjustable length butt stock assembly.

An adjustable length butt stock assembly 30 is illustrated in FIG. 1 It has a handgrip portion 31, a tubular member 32 and a butt stock 34 that is telescopically adjustable along the length of tubular member 32. The front end of butt stock assembly 30 is attached to the rear end of a receiver of a firearm such as a shotgun or a rifle. In the embodiment illustrated, the handgrip 31 and tubular member 32 are integrally formed but they could be separate parts that are secured to each other. Structure for reducing the recoil of the firearm can be located either in tubular member 32 or butt stock 34.

Figure 2:
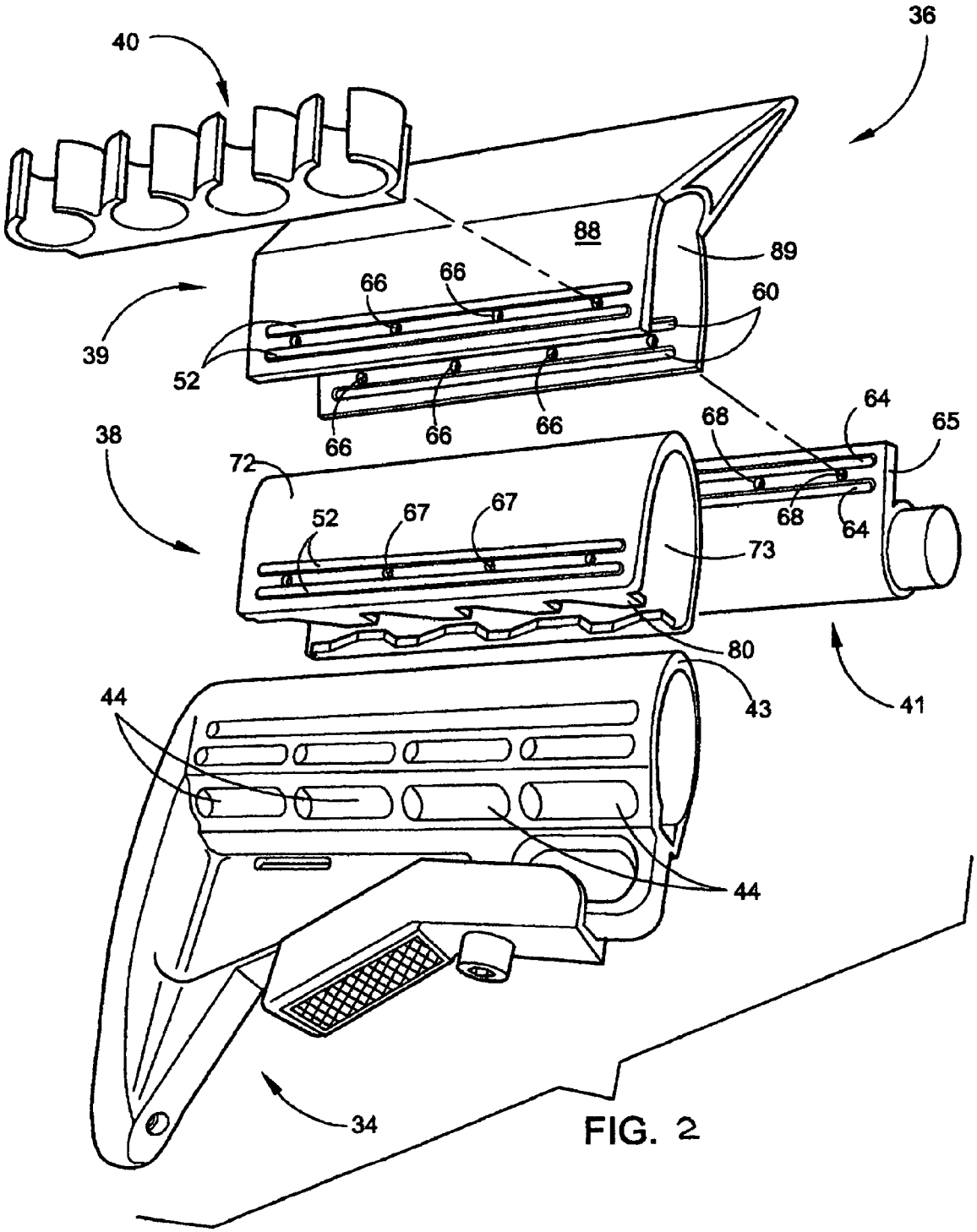
FIG. 2 is an exploded front perspective view of the modular cheek rest assembly prior to installation on the butt stock.

FIG. 2 is an exploded front perspective view of the modular cheek rest and storage assembly 36. It consists of four major parts plus two sets of different length screws. They are low level cheek rest 38, the high level cheek rest 39, shot gun shell holder 40 and the storage tube 41. If the firearm has a low level sight, low level cheek rest 38 would be used. Different options then exist. A shotgun shell holder 40 could be removably attached to either one or both sides of level cheek rest 38. Alternatively, storage tube 41 could be attached to either side of low level cheek rest 38 and a shotgun shell holder 40 attached to the other side. If an elevated sight is used on the firearm, then high level cheek rest 39 could have one or two of the shotgun shell holders 40 detachably secured to its opposite sides. Alternatively, a storage tube 41 could be detachably secured to one of the sides of high level cheek rest 39. The low level cheek rest 38 allows the person shooting the firearm to hold their face at the proper height to see the low level gun sight. The high level cheek rest 39 allows the person shooting the firearm to hold their face at the proper height to see an elevated gun sight.

Butt stock 34 has a tubular portion 43 adjacent its top end. Its outer surface has longitudinally spaced recesses or pockets 44 that detachably receive structure on low level cheek rest 38 for the purpose of securing the two members together. The manner in which this is accomplished will be discussed later at greater length.

Figure 5:
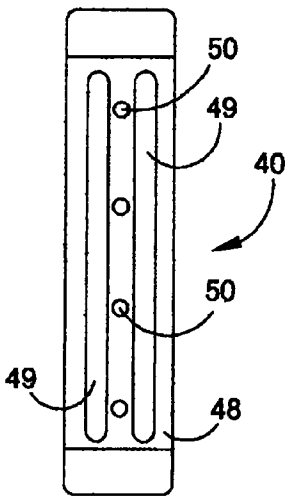
FIG. 5 is a rear view of the shotgun shell holder.
Figure 4:
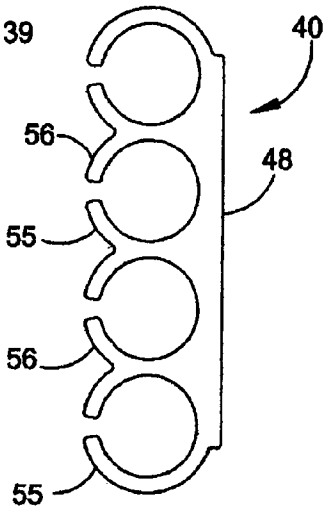
FIG. 4 is a top view of the shotgun shell holder.
Figure 3:
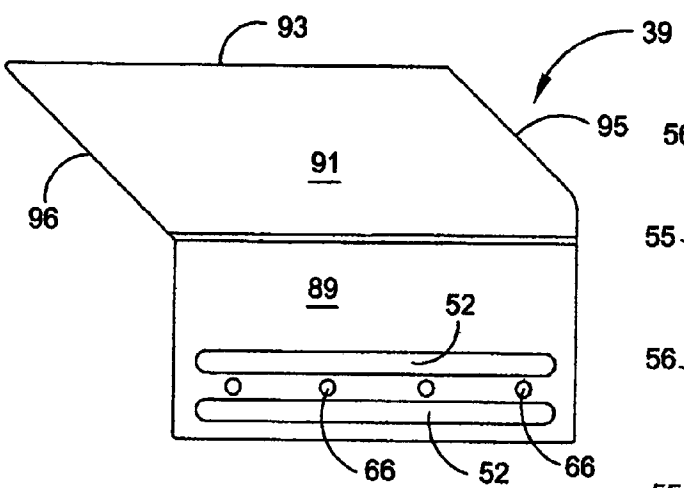
FIG. 3 is a side elevation view of the high level cheek rest.
Figure 11:
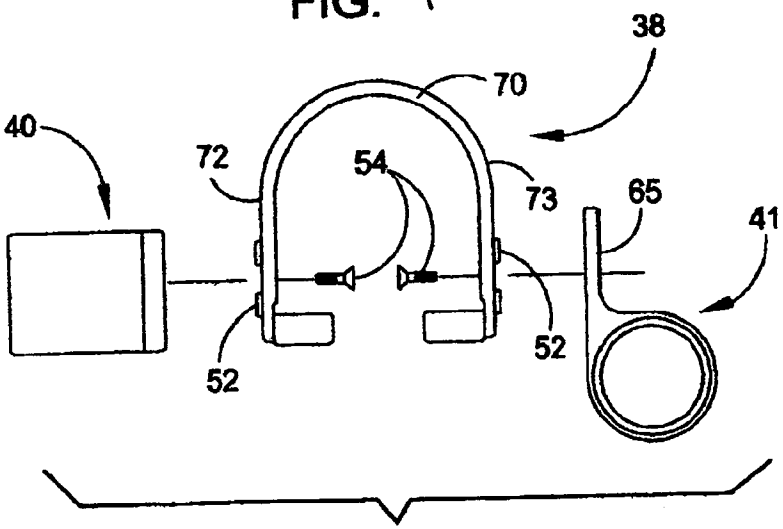
FIG. 11 is an exploded front elevation view of the low level cheek rest prior to installing the gun shell holder and the storage tube.
Figure 10:
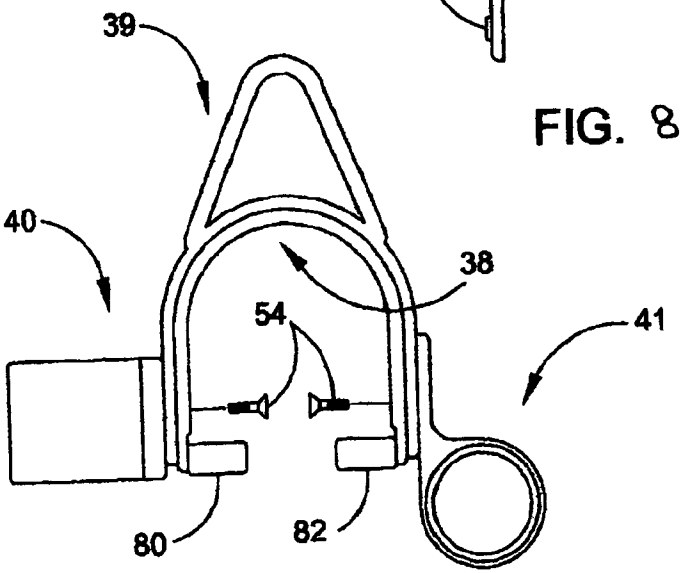
FIG. 10 is a front elevation view showing the high level cheek rest being installed on the low level cheek rest.
Figure 16:
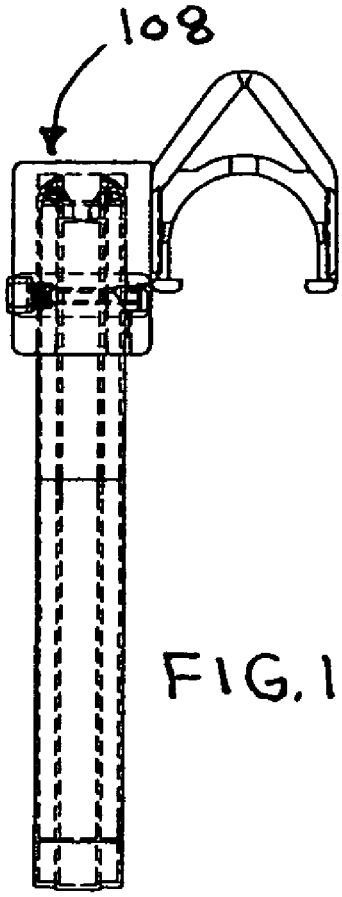
FIGS. 16-18 are schematic illustrations of the magazine holder mounted on the high level cheek rest
Figure 17:
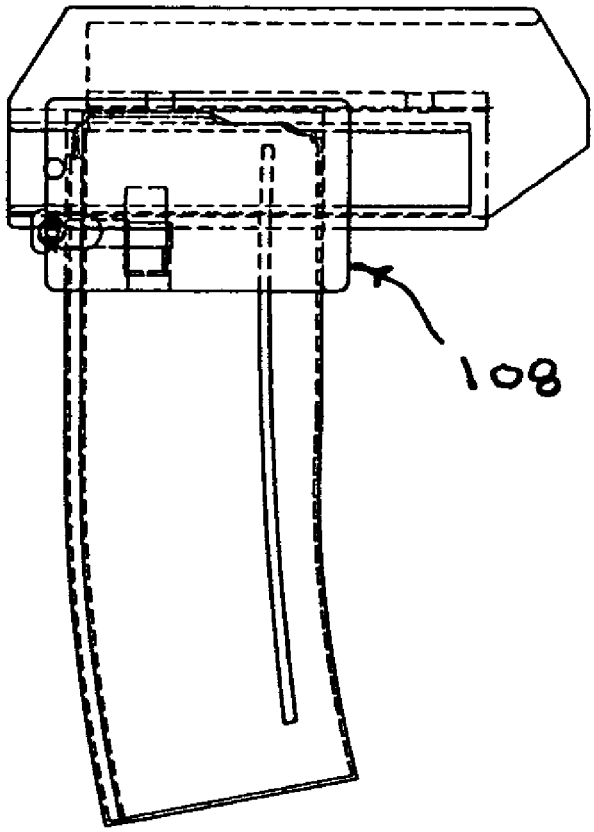
Figure 18:
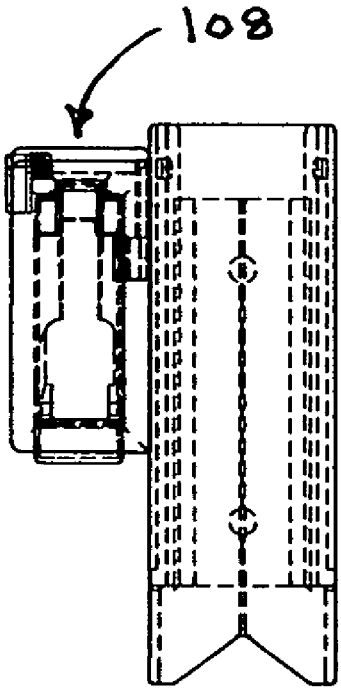

FIGS. 3-5 show the different components of the modular cheek rest and storage assembly. Two different length sets of screws can be used to assemble the different parts together. FIG. 11 shows a shotgun shell holder 40 attached to low level rest 38. FIG. 10 is a front elevation view showing high level cheek rest 39 attached to the outer surface of low level cheek rest 38. The shell shot holder 40 is attached to the outer surface of high level cheek rest 39. FIG. 10 shows the structure of storage tube 41 secured to the outer surface of high level cheek rest 39. Shotgun shells would be loaded in shotgun shell holder 40.

FIG. 11 shows the low level cheek rest 38 prior to installation on the tubular portion 43 of butt stock 34. Low level cheek rest 38 has a storage tube 41 and shotgun shell holder 40 detachably secured to it.

FIG. 5 is a rear view of shotgun shell holder 40 showing its rear wall 48 having a pair of vertically spaced longitudinally extending grooves or recesses 49 in its outer surface. These grooves or recesses would mate with the externally elongated protrusions 52 on the outer surface of either low level cheek rest 38 or high level cheek rest 39. Threaded bores 50 would also receive the screws 54. Adjacent fingers 55 and 56 define receptacle openings for removably receiving shotgun shells.

FIG. 2 shows the manner in which high level cheek rest 39 is snapped over the outer surface of the low level cheek rest 38. The outer surface of the side walls of low level cheek rest 38 have vertically spaced longitudinally extending protrusions or ridges 52. They mate and interlock with the respective longitudinally extending grooves or recesses 60 on the inner surface of the side walls of high level cheek rest 39. The protrusions or ridges 52 also mate with longitudinally extending grooves or recesses 49 on the rear surface of shotgun shell holder 40. Storage tube 41 has a flange 65 having longitudinally extending grooves or recesses 64 on the rear surface of the flange.

High level cheek rest 39 has longitudinally spaced threaded bore holes 66 that align with the threaded bore holes 67 in low level cheek rest 38. Storage tube 41 has threaded bore holes 100 that are longitudinally spaced to align with threaded bore holes 66 in high level cheek rest 39 and threaded bore holes 67 in low level cheek rest 38.

FIG. 11 is an exploded front elevation view of low level cheek rest 38, shot gun shell holder 40 and storage tube 41. Low level cheek rest 38 has an arcuate top portion 70 connected at its opposite ends by a left side wall 72 and a right side wall 73. Arcuate top portion 70 is substantially semicylindrical in shape. The outer surface of the respective left and right side walls 72 and 73 have longitudinally extending protrusions or ridges 52 (see FIG. 2). Longitudinally spaced threaded bore holes 67 receive screws 54 for attaching shotgun shell holder 40 and storage tube 41 to low level cheek rest 38 or high level cheek rest 39. FIG. 15 is a bottom plan view of low level cheek rest 38. It shows four longitudinally spaced teeth 80 extending inwardly from left side wall 72. It shows four inwardly extending teeth 82 from right side wall 73.

Low level cheek rest 38 is always the first member to be installed on the top end of butt stock 34. Teeth 80 and 82 extend inwardly from the bottom ends of the respective left and right side walls 72 and 73. For installation on butt stock 34, the rear end of low level cheek rest 38 is first positioned in front of the tubular portion 43 with the teeth 80 and 82 aligned with the recesses or pockets 44. Next low level cheek rest 38 is slid rearwardly toward the butt pad rear end. Low level cheek rest 38 has a rear end 84 and a front end 85. The respective teeth have a built in angle at the front end so that the respective left and right side walls are forced outwardly until they click into the recesses 44. There are four teeth and four recesses or pockets for the teeth to click in when the low level cheek rest is fully installed. At that time the low level cheek rest is firmly locked onto the butt stock.

Prior to installing low level cheek rest 38 onto the butt stock, there are several options to be exercised. A shotgun shell holder may be installed on either one or both side walls of the low level cheek rest. Likewise, a storage tube 41 may be installed on one of the side walls 72 or 73. When only the low level cheek rest 38 is to be used, the shorter screws 54 would be used to attach the shotgun shell holder 40 and storage tube 41.

The design of the teeth 80 and 82 on the bottom of low level cheek rest 38 is important because this structure is the only thing attaching it to butt stock 34. It is not necessary to threadably attach the low level cheek rest 38 to the butt stock. If you want to use a high level cheek rest for high elevated sights, like red dots, first you need to remove the low level cheek rest 38. Next any shotgun holders 40 or storage tubes 41 would have to be removed from the low level cheek rest. Now the high level cheek rest 39 is snapped onto the outer surface of low level cheek rest and the protrusions or ribs 52 on the outer surface of low level cheek rest 38 would snap into the longitudinal grooves or recesses 60 on the inner surface of a left side wall 88 and the right side wall 89 of high level cheek rest 39. Next the longer version of screws 54 would be used to attach the shotgun holders 40 and storage tube 41 to the combined structure of the high level cheek rest 39 and the low level cheek rest 38. The next step is to slide the assembled structure onto the tubular portion 43 of butt stock 34 again allowing the teeth 80 and 82 to click into the recesses or pockets 34.

Figure 7:
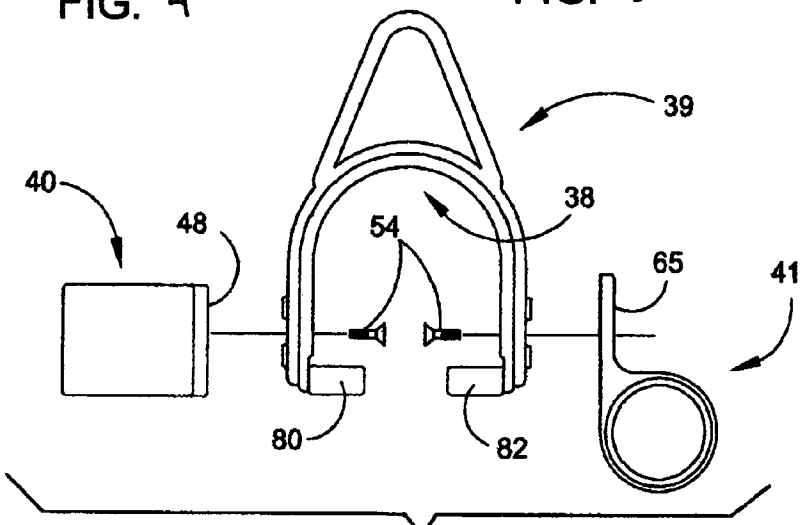
FIG. 7 is an exploded front elevation view showing the high level cheek rest being installed on the low level cheek rest.
Figure 6:
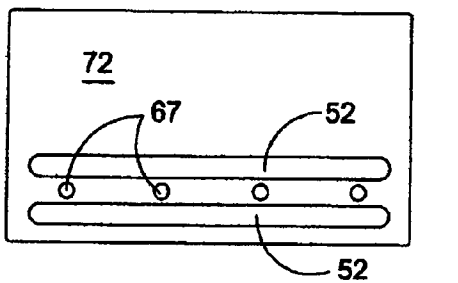
FIG. 6 is a side elevation view of the low level cheek rest.
Figure 9:
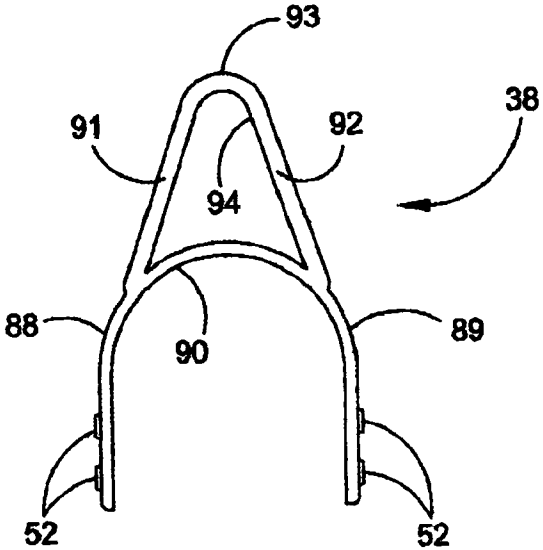
FIG. 9 is a front elevation view of the high level cheek rest.
Figure 8:
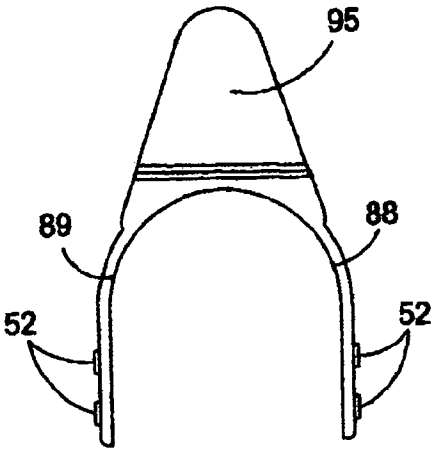
FIG. 8 is a rear elevation view of the high level cheek rest.

The structure of high level cheek rest 39 will be best understood by referring to FIGS. 2 and 7-10. High level cheek rest 39 has a left side wall 88, a right side wall 89 and an arcuate top portion 90. An upper left wall 91 and an upper right wall 92 are inclined toward each until they reach a crown 93 and form a chamber 94 therein. Rear wall 95 closes the chamber. A hood portion 96 extends forwardly in front of the respective left side wall 88 and right side wall 89. FIG. 7 is an exploded view of low level cheek rest 38, high level cheek rest 39, shotgun shell holder 40 and storage tube 41. FIG. 10 is an assembled view of the structures.

FIGS. 4, 5 and 7 illustrate shotgun shell holder 40 and identify its structural members.

FIGS. 12-14 illustrate the storage tube 41. Storage tube 41 would be a water tight tube in which various items could be stored. It would be primarily used to store an auxiliary battery for a laser or red dot sighting unit. Tubular member 98 is opened at each of its ends. A cap 102 and two O-rings 103 would close its one end. A cap 104 and two O-rings 105 would close its other end. The rear of flange 65 would have longitudinally extending grooves 64 that mate with protrusions or ridges 52 of either low level cheek rest 38 or high level cheek rest 39.

A magazine holder 108 (FIGS. 12-18) could be used instead of a shotgun shell holder 40. It could be removably secured to one of the side walls of either high level cheek rest 39 or low level cheek rest 38.

Although this invention has been described in connection with specific forms and embodiments thereof it will be appreciated that various modifications other than those discussed above may be resorted to without departing from the spirit or scope of the invention. For example, equivalent elements may be substituted for those specifically shown and described, certain features may be used independently of other features, and the number and configuration of various components described above may be altered, all without departing from the spirit or scope of the invention as defined in the appended claims.

What is claimed is:

1. A modular cheek rest assembly for a gun stock comprising:

an elongated tunnel-shaped cheek rest having a front end and a rear end and a top wall portion connected at its opposite ends by a left side wall and a right side wall;

said left and right side walls each having an outer surface, an inner surface and a bottom end; and engagement means adjacent said bottom ends of said left and right side walls detachably securing said cheek rest to a butt stock of a firearm, wherein said engagement means comprise a plurality of longitudinally spaced teeth that extend inwardly from said inner surfaces of said left and right side walls.

2. A modular cheek rest assembly as recited in claim 1 wherein said outer surface of said left and right side walls have attachments means for securing auxiliary parts thereto.

3. A modular cheek rest assembly as recited in claim 2 wherein said attachment means are longitudinally spaced threaded holes in said outer surface of said left and right side walls.

4. A modular cheek rest assembly as recited in claim 1 wherein said engagement means are detachably engageable with corresponding recesses in the respective left and right recesses in the outer surface of said butt stock.

5. A modular cheek rest assembly as recited in claim 4 in with said butt stock having left and right outer surfaces that have longitudinally spaced recesses for detachably engaging said teeth of said cheek rest.

6. A modular cheek rest assembly as recited in claim 4 wherein said cheek rest is made of a semi-rigid material that allows said left and right side walls to be temporarily sprung apart in order for said teeth to be engaged in recesses in a butt stock.

7. A modular cheek rest assembly as recited in claim 1 wherein said top wall portion is substantially semi-cylindrical in shape.

8. A modular cheek rest assembly as recited in claim 1 further comprising primary alignment means in said outer surfaces of said left and right side walls that aligns with mating secondary alignment structure on auxiliary parts that are detachably secured thereto.

9. A modular cheek rest assembly as recited in claim 8 wherein said primary alignment means comprises elongated protrusions on the outer surfaces of said left and right side walls.

10. A modular cheek rest assembly as recited in claim 1 further comprising a shotgun shell holder detachably secured to one of the side walls of said cheek rest.

11. A modular cheek rest assembly as recited in claim 1 further comprising an elongated tunnel-shaped high level cheek rest detachably secured to the outer surfaces of said cheek rest.

12. A modular cheek rest assembly as recited in claim 1 further comprising a storage tube detachably secured to one of said side walls of said cheek rest.

13. A modular cheek rest assembly as recited in claim 1 further comprising a magazine holder detachably secured to one of said side walls of said cheek rest.

14. A modular cheek rest assembly as recited in claim 1 wherein said engagement means comprise a plurality of longitudinally spaced teeth that extend inwardly from said respective bottom ends of said inner surfaces of said left and right side walls.

15. A modular cheek rest assembly as recited in claim 1 wherein said engagement means are integral extensions of said side walls.

16. A modular cheek rest assembly as recited in claim 1 wherein when said modular cheek rest is secured to said butt stock via said engagement means, said modular cheek rest is stationary with regard to said butt stock.

* * * * *